US006741712B2

(12) United States Patent
Bisgaard

(10) Patent No.: US 6,741,712 B2
(45) **Date of Patent: *May 25, 2004**

(54) TIME-CONTROLLED HEARING AID

(75) Inventor: Nikolai Bisgaard, Lyngby (DK)

(73) Assignee: GN ReSound A/S, Taastrup (DK)

( * ) Notice: Subject to any disclaimer, the term of this patent is extended or adjusted under 35 U.S.C. 154(b) by 174 days.

This patent is subject to a terminal disclaimer.

(21) Appl. No.: 09/886,329

(22) Filed: Jun. 21, 2001

(65) Prior Publication Data

US 2001/0055404 A1 Dec. 27, 2001

Related U.S. Application Data

(63) Continuation of application No. PCT/DK99/00687, filed on Dec. 8, 1999.

(30) Foreign Application Priority Data

Jan. 8, 1999 (DK) ..... 1999 00017

(51) Int. Cl.[7] ..... H04R 25/00

(52) U.S. Cl. ..... 381/312; 381/315

(58) Field of Search ..... 381/60, 312, 314, 381/315, 316, 320, 323, 328, 331; 600/559

(56) References Cited

U.S. PATENT DOCUMENTS

| | | | | |
|---|---|---|---|---|
| 4,049,930 A | * | 9/1977 | Fletcher et al. | 381/60 |
| 4,777,474 A | * | 10/1988 | Clayton | 381/312 |
| 4,821,247 A | * | 4/1989 | Grooms | 368/63 |
| 4,972,487 A | | 11/1990 | Mangold et al. | |
| 5,210,803 A | | 5/1993 | Martin et al. | |
| 6,008,720 A | * | 12/1999 | Hongu et al. | 340/309.15 |

* cited by examiner

*Primary Examiner*—Suhan Ni
(74) *Attorney, Agent, or Firm*—Bingham McCutchen LLP; David G. Beck

(57) ABSTRACT

A hearing aid which comprises a sound transducer, an analogue-digital converter, a digital processing and adaptation circuit for the processing of digital signals, corresponding to audio signals which are received by the transducer, storage units for the storage of data and programmes for the digital processing and adaptation circuit, a digital-analogue converter and a sound generator. The hearing aid also contains a counter, which registers the time for which the hearing aid has been in use, and a non-volatile storage unit in which the utilisation time is summed up. The hearing aid is arranged in such a manner that a comparison is made between the contents of that part of the non-volatile storage unit in which the summed-up utilisation time is stored and one or more limit values, and so that when one or more of the limit values is reached, a special function is initiated.

10 Claims, 2 Drawing Sheets

TIME-CONTROLLED HEARING AID

Figure 1:
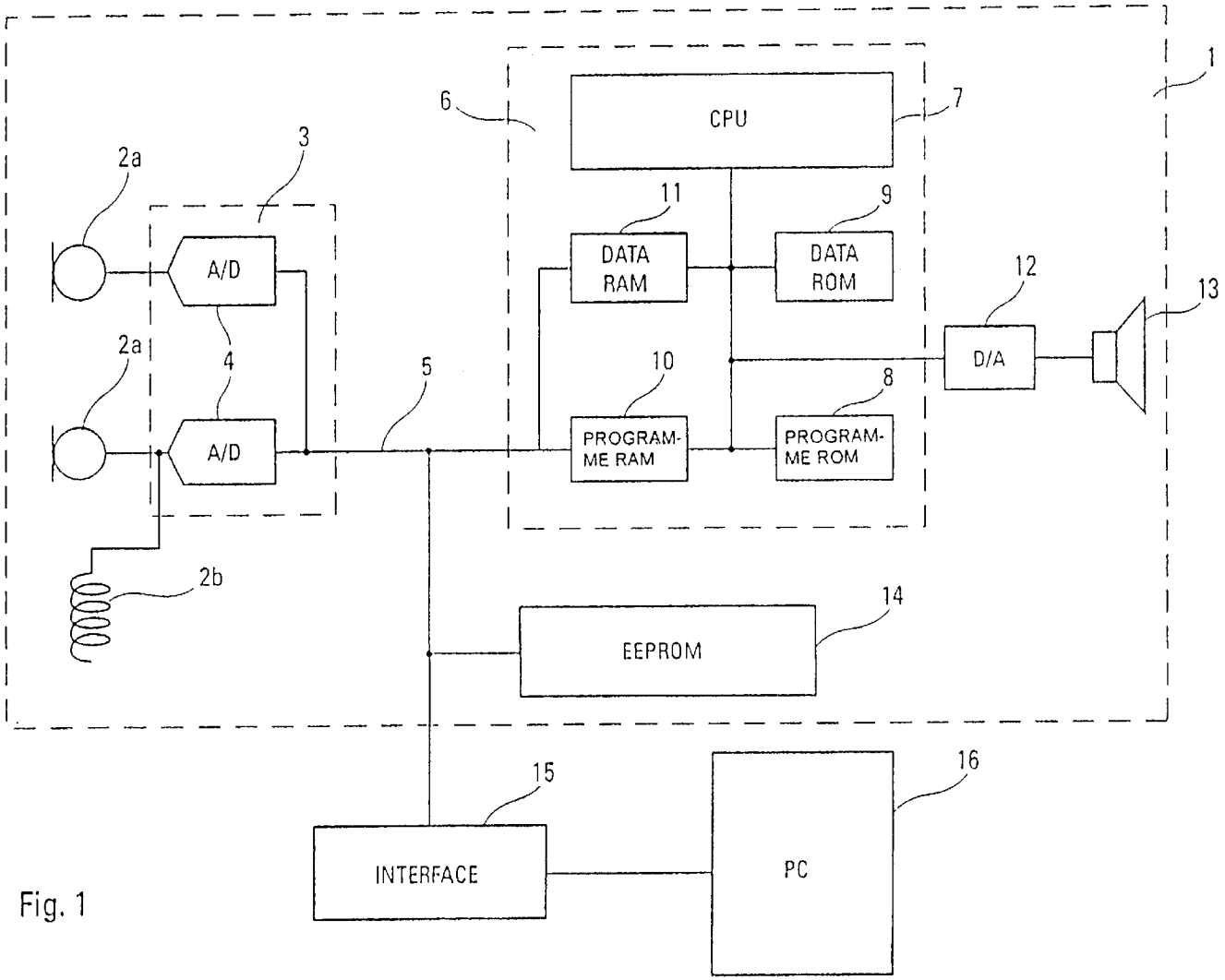

This application is a continuation of international application Ser. No. Pct/OR99/00687 filed Dec. 8, 1999.

The invention concerns a hearing aid of the kind which comprises a sound transducer, an analogue-digital converter, a digital processing and adjustment circuit for the processing of digital signals, corresponding to audio signals which are received by the transducer, memory units for the storage of data and programmes for the digital processing and adjustment circuit, a digital-analogue converter and a speaker.

A hearing aid of this known kind is described for example in the U.S. Pat. No. 4,972,487, which concerns a programmable hearing aid which also contains data logging means. With this data logger it can be registered how many times each programme is activated, and for how long each programme is used. By the reading out of the data registered, an audiologist or a fitter or the like can ascertain for how long and how many times the individual user of the hearing aid has used the individual programmes over an elapsed period of time.

Known hearing aids of this kind are normally sold to the user as a one-time service at a relatively high purchase price. In addition to the hearing aid itself, this purchase price also covers an obligation, which the hearing aid dealer undertakes, to provide the user with service with regard to subsequent adjustment, advice, maintenance etc. for a subsequent period. which is normally of 3–5 years. All repairs are covered by a guarantee of 1–2 years, which thereafter are paid for by the user, but these repairs can, however, be covered if extra insurance is taken out.

For several various reasons, it would be desirable if the hearing aids could be sold in connection with subscription arrangements in the same way as e.g. is known in connection with contact lenses, where a start fee is paid upon establishing a subscription agreement, after which regular subscription fees are paid which cover, e.g. an annual check-up of the eyesight and continuous deliveries of new lenses.

For the hearing aid dealer, such an arrangement would have the advantage that this would provide a continuous income. For the users of the hearing aids, the advantage would be that the relatively high one-time service price upon acquiring the hearing aid would be spread over a series of years, and the users will also have the advantage that providing the regular subscription fee is paid, they will be ensured that repairs, service etc. of the hearing aid will be carried out and moreover, that they will be able to have their hearing checked regularly in connection with the subscription.

However, such a subscription arrangement in connection with hearing aids requires that it is possible to stop the current services if the user does not pay the subscription fees, in the same way as the regular deliveries of new contact lenses can be stopped in connection with lens subscribers.

This is achieved in a hearing aid of the kind disclosed in the introduction which contains a counter element for the registration of the utilisation time and a storage unit for the storage of this data, and which is characteristic in that the counter element comprises a counter for the registration of the time the hearing aid has been used, that the storage unit for the storage of this data comprises a non-volatile memory in which the utilisation time is summed up, that the hearing aid is arranged in such a manner that a comparison is made between the contents of that part of the non-volatile memory in which the summed-up utilisation time is stored and one or more limit values, and that when one or more of the limit values is reached, a special function is initiated.

The total time for which the hearing aid is used will hereby be registered currently in the hearing aid, and when one or more limit values are exceeded, in that a limit value can be set e.g. for a subscription period, said limit values having been previously stored in the hearing aid, a special function will be initiated which indicates to the user that the subscription period has expired or is nearing expiry. The user can hereafter take the steps necessary for extending the subscription.

As disclosed in claim 2, it can be expedient for the special function which is initiated to consist of a deactivation of the hearing aid, in that e.g. when the limit value is exceeded, a disconnection of the hearing aid battery or other vital functions in the aid can be effected.

As characterized in claim 3, the special function can consist of an alarm arrangement, whereby in the event of a first limit value being exceeded, the user is made aware that the subscription period has expired or is nearing expiry, e.g. by the hearing aid emitting a short acoustic signal which is possibly repeated. If the subscription is not renewed, this can be combined with the deactivation of the hearing aid after a second limit value is exceeded.

Finally, as disclosed in claim 4, the exceeding of a limit value can initiate a changing of the parameters and/or programmes which have influence on the operation of the hearing aid, so that an updating of the function of the hearing aid can take place automatically after a certain period of time, either in connection with the expiration of a subscription period or at a random time determined by the dealer or the audiologist.

The renewal of the subscription can naturally take place by the user paying a visit to the dealer (audiologist), who will update the hearing aid by means of the PC equipment, which is normally used when the hearing aid is set for use. As disclosed in claim 5, it can be-expedient for this to be carried out when the hearing aid is arranged to detect special reactivation signals. The detection of such reactivation signals, which e.g. can be, coded signals, results in the updating of the hearing aid.

As disclosed in claim 6, this updating can, for example, consist of the counter for the summed-up utilisation time being set to zero, so that a new subscription period can be started, or as disclosed in claim 7, that the stored limit value or values are increased corresponding to a new subscription period. With the latter method, the further advantage is achieved that the time counter will thus always contain a measure of the total utilisation time.

Moreover, with the updating, it can be expedient for further changes to be made in the data and/or the programmes which are stored in the hearing aid, as disclosed in claim 8, whereby an automatic updating of the function of the hearing aid is effected. For example, this can be the case in connection with new users, where use is made of a habituation system. With such a habituation system, there will occur a gradual transition from no hearing aid to full compensation for the user's loss of hearing.

For the user, however, it will be an inconvenience to have to visit the dealer/audiologist to have the hearing aid updated by means of the PC equipment, which the dealer uses for adjustment of the hearing aid.

As disclosed in claim 9, the hearing aid can therefore be supplied with reactivation signals by special audio signals being sent to the hearing aid's microphone. For example, this can be effected by the user telephoning to the dealer/audiologist, or vice-versa, (for example when the subscription fee for the following period has been paid), and that the audiologist then transfers the code signals via the telephone connection white the user holds the hearing aid close to the telephone receiver. The updating can hereby be effected quickly without the user having to visit the dealer/audiologist.

Other methods by which audio signals can be transferred to the hearing aid can be envisaged. For example, the dealer/audiologist can send a postcard with an audio chip or a tape on which the coded audio signals have been recorded, or use can be made of the Internet to transfer audio signals to the user's hearing aid. After a subscription fee has been paid, the user can thus get the coded signals transferred by calling an Internet address from a PC. The payment of the subscription fee can also possibly be made over the Internet, so that with a single call the user cannot only make the payment but also get the coded signals transferred to the hearing aid.

In connection with the use of coded audio signals as reactivation signals, use can be made, for example, of the DTMF signals (Dual Tone Multi-Frequency), for example well known from the telephone systems, where two simultaneous pure tones are used to signal a digit between 0 and 9. Such signals are relatively easy to detect in the hearing aid's digital signal processing circuit, and at the same time an ordinary telephone keypad can be used as coding apparatus.

Finally, as disclosed in claim 10, the hearing aid can be arranged with a number of code keys, pushbuttons or the like, so that the reactivation signals can be entered by the user. This has the advantage that the code can be sent to the user in writing, expressed as the entries, which must be made, after which the user himself can key in the code at a convenient time.

In both cases it will be an advantage that the code is changed from time to time, so that the user cannot just copy a code from a previous subscription period, e.g. by recording the coded audio signals on tape, and use this for the subsequent subscription period(s).

Figure 2:
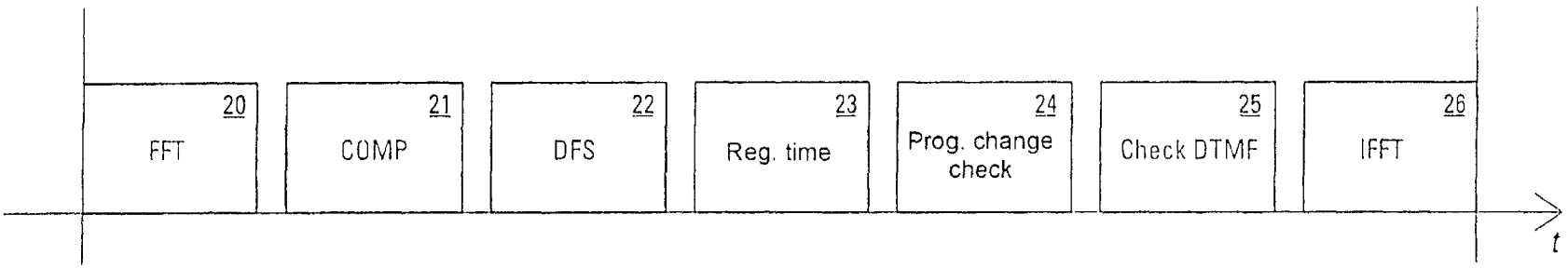

In the following, the invention will be explained in more detail with reference to the drawing, where FIG. 1 shows a block diagram of a digital hearing aid according to the invention, and FIG. 2 shows an example of a signal-processing block in a digital hearing aid according to the invention.

An example of a digital hearing aid according to the invention is shown in block diagram form in FIG. 1. The hearing aid, which is indicated in general by the reference FIG. 1, contains one or more sound transducers 2 such as microphones and tele-coils. In the example shown, use is thus made of two microphones 2*a* and a tele-coil 2*b*. The analogue signal(s) from the sound transducers 2*a* and 2*b* are coupled to an analogue-digital conversion circuit 3, which contains an analogue-digital converter 4 for each of the transducers 2*a* and 2*b*.

The digital signal outputs from the analogue-digital converters 4 are coupled to a common digital conduction bus 5, which feeds the signals to a digital signal processing and adaptation circuit 6. This circuit which, for example, can be in the form of a digital signal processor (DSP), and which will be described in more detail later, is programmed to carry out the necessary operations on the digital signals with the object of effecting the necessary adaptation of the signals and to adjust the hearing aid for the actual user.

From the digital conduction bus 5, output signals are fed to a digital-analogue converter 12, from which analogue output signals are fed to a sound transducer 13 such as a speaker.

Furthermore, the hearing aid contains an external memory 14 in relation to the digital signal processing and adaptation circuit 6, which in the example shown is an EEPROM (Electronically Erasable Programmable Read-Only Memory). This external memory 14, which is connected to the digital conduction bus 5, can be provided with programmes, data, parameters etc. that can be entered from a PC 16 via an interface 15. For example, this will be the case when a new hearing aid is allotted to a concrete user, and the hearing aid is adjusted to suit precisely this user, or when a user gets his/her hearing aid updated and/or adjusted by an audiologist for the user's actual loss of hearing.

The digital signal processing and adaptation circuit 6, which in the example shown consists of a digital signal processor (DSP), contains a central processor (CPU) 7 and a number of internal storage units 8–11, said internal storage units containing data and software which are currently implemented in the digital signal processing and adaptation circuit 6. The circuit 6 thus contains a programme-ROM (Read-Only Memory) 8, a data-ROM 9, a programme-RAM (Random Access Memory) 10 and a data-RAM 11. The two first-mentioned contain programmes and data which constitute permanent elements in the circuit, while the two last-mentioned contain programmes and data which can be replaced or overwritten.

The external EEPROM 14 is normally considerably larger, e.g. 4–8 times larger, than the internal RAM, which means that certain data and programmes can be stored in the EEPROM for reading into the internal RAMs for execution when there is need for them, in that these special data and programmes can later again be overwritten by the normal operational data and operating programmes. The external EEPROM can thus contain a number of programmes, which are used only in special cases, such as e.g. start-up programmes.

In the digital signal processing and adaptation circuit 6, the signal processing will be effected in blocks, each of which contains a number of signal processing stages and data operations. These stages will be executed one by one and will be repeated in the individual blocks in the same pattern in fixed time frames. This is illustrated in FIG. 2, which shows a single signal-processing block in a temporal sequence, which sequence is repeated during the whole of the hearing aid's operating period.

The signal processing starts by a Fourier transformation of the signals from the time domain to the frequency domain being carried out on the sampled digital signals from the analogue-digital conversion circuit 3. In the example, use is made of a Fast-Fourier-Transformation (FFT), as illustrated at the stage 20. Hereafter, a compression (COMP) is typically carried out as illustrated at stage 21, with the object of bringing the signals within a desirable processing range. The object of this compression is to adapt the signal to the actual user, in that those frequencies at which the user has a loss of hearing will be raised in relation to the remaining frequencies in such proportion that the hearing loss will be neutralised. There is then effected a filtration by means of an adaptive filter (DFS) at stage 22, the object being to suppress a possible tendency towards acoustic feedback. Moreover, other types of desirable signal processing will be able to be effected before the last stage 26 in the block, where an inverse Fast-Fourier-Transformation (IFFT) of the signals back to the time domain is carried out. As shown in FIG. 1, these signals will be fed to the digital-analogue converter 12, after which the corresponding analogue signals are fed to the speaker 13.

The block described above consisting of a group of stages will, for example, have a temporal sequence which extends over 4 ms, so that the block will be repeated every 4 ms. If, for example, the sampling frequency is 16 kHz, during the course of 4 ms there will be collected 128 samples which are stored in the data-RAM 11. The block oriented signal processing will thus be carried out on such a group of 128 samples, starting with a Fast-Fourier-Transformation in stage 20.

In addition to the already described examples of types of signal processing, the block in FIG. 2 will further comprise three system operations or programmes, which are repeated every fourth millisecond.

The object of the programme 23 (Reg. Time) is to register the utilisation time for the hearing aid, and it functions by use of two storage units ("counter" and "hour counter") in data-RAM 11. When the programme 23 is executed, it will read the contents of the storage unit "counter" and increase the value by 1. With a run-through time for a block of 4 ms, an hour will have elapsed when the contents of the storage unit "counter" has reached up to the value 900,000. When this happens, the programme 23 will cause the storage unit "counter" to be set to zero, and the "hour counter" storage unit to be increased by 1. At the same time, the programme will ensure that the new value of the storage unit "hour counter" is transferred to a corresponding storage unit (hour counter) in the external EEPROM 14. The actual number of hours for which the hearing aid has been in operation will thus always be able to be read out from the external memory 14.

The programme 24 (Prog. change check) serves to check whether a change should be made to another programme, e.g. if the "hour counter" storage unit has reached one of the stored limit values, or if the user by the activation of an external pushbutton causes an interrupt with the view to changing between two or more conditions or programmes.

The object of the Programme 25 (Check DTMF) is to test whether the data which is currently being handled in the block contains signals which will give rise to the implementation of an updating of the hearing aid, such as e.g. a zero-setting of the "hour counter" storage unit in the internal data-RAM 11 and in the external EEPROM 14, or an updating of the limit values which are stored in the external EEPROM 14, and possibly a changing of other data in the data-RAM 11, the program-RAM 10 and/or the external EEPROM 14. These signals, which in the following are referred to as reactivation signals, can be any form of coded signals which can be recognized during data processing by the programme 25.

For example, use can be made of the well-known DTMF signals (Dual Tone Multi-Frequency), where two simultaneous pure tones are used to signal a given digit between 0 and 9. In an FFT-based structure as that described above, it is relatively simple to test whether there are DTMF signals in those signals, which are fed into the digital signal processing and adaptation circuit 6 from the microphones 2. The programme 25 can thus detect such DTMF signals and, providing a given combination is detected, can activate a special programme stored in the external EEPROM 14. The special programme can, for example, reset to zero the "hour counter" storage unit in the internal data-RAM 11 and in the external EEPROM 14 and/or set a new maximum value for the utilisation time, which maximum value can be stored in the external EEPROM 14. Finally, by transferring changes from the external EEPROM 14 to data-RAM 11 and program-RAM 10, the special programme can carry out an updating or changing of the data and/or programmes for the digital signal processing.

The reactivation signals, such as e.g. DTMF signals, can be introduced in the signals from the sound transducers, e.g. by the supply of audio signals to the microphones 2, or by signals which are generated by means of a code keypad in the hearing aid being introduced into the hearing aid's signal circuit. Finally, the reactivation signals can naturally be fed directly to the hearing aid, e.g. by an audiologist using a PC 16 and an interface 15, such as shown in FIG. 1. However, this naturally requires that the hearing aid user visits the audiologist with his/her hearing aid, or gives the audiologist access to the aid in another manner.

If this involves audio signals which are transferred to the hearing aid's microphones, this can be carried out e.g. over a normal telephone line, in that the hearing aid user can hold the hearing aid up against the telephone handset, so that the microphones in the hearing aid can receive the sound from the telephone receiver. The coded signals can also be transferred to the hearing aid user in other ways, e.g. in the form of tape recordings or audio chips with the desired code sequence which can be sent to the user as ordinary mail.

The audio signals can also be transferred to the user's hearing aid via the Internet, in that after the subscription fee has been paid, the user can call an Internet address from his/her PC and have the code signals transferred. The payment of the subscription fee can possibly also take place over the Internet, so that both the payment and the transfer of the coded signals to the hearing aid can be effected with a single call by the user.

If a code keypad is used on the hearing aid, in its simplest form this can consist solely of two keys with which the hearing aid users can enter a code sequence, which has been sent to them. More than two keys can, of course, be used for the entering of code sequences, such as e.g. a telephone keypad of the kind normally used.

In the fitting of a user with a hearing aid, the dealer/audiologist will have provided the hearing aid with the programmes and the data, which are necessary for its operation. There will thus be entered the programmes and data which control the signal adjustment with the view to compensating for the user's hearing loss for at least a first period. Moreover, among other things, at least the maximum utilisation time for the first subscription period will be entered and, if a habituation system is used where the compensation is to be gradually increased, the data and/or the programmes, which are to be used in the signal processing for at least the following period.

When the hearing aid is switched on by the user and taken into use, the first thing to be entered from the external EEPROM 14 will be a start-up programme which, among other things, checks whether the summed-up utilisation time (stored in the "hour counter" storage unit), has exceeded one or more of the stored limit values for the utilisation time. If this is the case, this will result in the initiation of a special programme which, if a subscription period has expired or is about to expire, can e.g. execute an alarm or signalling function, e.g. in the form of a series of audio signals, and/or which can deactivate the hearing aid e.g. by breaking the connection to the speaker, after which the normal operating programme will not be initiated.

If none of the stored limit values have been exceeded, an operating programme will read in from the external EEPROM, after which the hearing aid will function in the normal manner.

In the updating of the hearing aid, i.e. when the hearing aid detects a series of reactivation signals, a special programme will be initiated in the digital circuit which checks whether the coded signal is that which is expected (i.e. corresponding to a code which is stored in the EEPROM), and in such case among other things an updating of the stored limit values will be effected, e.g. in the form of a writing-up for the expiry of the next subscription period, or alternatively a setting of the summed-up utilisation time to zero. Moreover, e.g. when a habituation system is used, a changing of the parameters and/or programmes which are used for the signal processing will take place, e.g. by the selection from the EEPROM of new data and/or programmes which are to be used in connection with the operating programme. Finally, a new code can possibly be selected for the reactivation signals, and this code will then be that which is expected to be used at the next updating of the hearing aid.

The said limit values for the utilisation time can be determined in different ways. For example, an upper limit value can be entered which corresponds to the lifetime it is desired to give the hearing aid, e.g. 3 years. Such a determination is encumbered with considerable uncertainty, in that the user pattern is not known. Normally, the daily use will be estimated to be 16 hours, so that an upper limit of 3 years will correspond to a summed-up utilisation time of approx. 18,000 hours. After a certain period of time, during a service visit to the dealer/audiologist, the utilisation time can, however, be read out from the hearing aid to a PC programme, and since the date on which the hearing aid was taken into use is known, this provisional utilisation time can be used to estimate the average daily use with greater precision, so that new limits can then be entered with a greater degree of certainty.

What is claimed is:

1. A hearing aid which comprises a sound transducer, an analogue-digital converter, a digital processing and adaptation circuit for the processing of digital signals, corresponding to audio signals which are received by the transducer, storage units for the storage of data and programs for the digital processing and adaptation circuit, a digital-analogue converter, a sound generator, a counter element for the registration of utilization time, and a storage unit for the storage of utilization time, wherein the counter element contains a counter which registers that time for which the hearing aid has been in use, that the storage unit for the storing of the utilization time comprises a non-volatile memory unit in which the utilization time is summed up, that the hearing aid is arranged in such a manner that a comparison is made between the contents of that part of the non-volatile memory unit in which the summed-up utilization time is stored and one or more limit values, and that when one or more of the limit values has been reached, a special function is initiated.

2. The hearing aid according to claim 1, wherein the special function which is initiated when a limit value is reached is a deactivation of the hearing aid.

3. The hearing aid according to claim 1, wherein the special function which is initiated when a limit value is reached is an alarm function.

4. The hearing aid according to claim 1, wherein the special function which is initiated when a limit value is reached is a changing of parameters and/or programs which are stored in the digital processing and adaptation circuit.

5. The hearing aid according to claim 1, wherein the digital adaptation and signal processing circuit is arranged to detect the presence of reactivation signals in the digital signal flow and, depending on the presence of such signals, to initiate one or more special functions.

6. The hearing aid according to claim 5, wherein the hearing aid is arranged in such a manner that upon detection of a reactivation signal, a zero-setting is carried out of that part of the non-volatile memory unit in which the utilization time is summed up.

7. The hearing aid according to claim 5, wherein the hearing aid is arranged in such a manner that upon detection of a reactivation signal, there is carried out an increase of one or more of the limit values with which the summed-up utilization time is compared.

8. The hearing aid according to claim 5, wherein upon detection of a reactivation signal, a changing of parameters and/or programs is also carried out.

9. The hearing aid according to claim 5, wherein the hearing aid is arranged in such a manner that the reactivation signals are introduced into the hearing aid's digital signal flow, this being effected by supplying special audio signals, corresponding to the reactivation signals, to the hearing aid's transducer.

10. The hearing aid according to claim 5, wherein the hearing aid is arranged in such a manner that the reactivation signals are introduced into the hearing aid's digital signal flow, in that the hearing aid has a number of code keys with which a special code, corresponding to the reactivation signals, is fed into the hearing aid.

* * * * *

UNITED STATES PATENT AND TRADEMARK OFFICE

CERTIFICATE OF CORRECTION

PATENT NO. : 6,741,712 B2
DATED : May 25, 2004
INVENTOR(S) : Nikolai Bisgaard

It is certified that error appears in the above-identified patent and that said Letters Patent is hereby corrected as shown below:

Column 2,
Line 38, replace “can be, coded signals,” with -- can be coded signals, --

Column 3,
Line 1, replace “connection white” with -- connection while --
Line 46, delete “FIG.”

Column 7,
Lines 40 and 42, delete “that”

Column 8,
Line 1, delete “that”

Signed and Sealed this

Fourteenth Day of December, 2004

JON W. DUDAS
*Director of the United States Patent and Trademark Office*